US007964021B2

(12) United States Patent
Younsi et al.

(10) Patent No.: US 7,964,021 B2
(45) Date of Patent: Jun. 21, 2011

(54) SYSTEMS AND METHODS FOR INDUCING SWIRL IN PARTICLES

(75) Inventors: Abdelkrim Younsi, Ballston Lake, NY (US); Robert Warren Taylor, Ponte Verda Beach, FL (US)

(73) Assignee: General Electric Company, Schenectady, NY (US)

( * ) Notice: Subject to any disclaimer, the term of this patent is extended or adjusted under 35 U.S.C. 154(b) by 436 days.

(21) Appl. No.: 12/122,032

(22) Filed: May 16, 2008

(65) Prior Publication Data

US 2009/0282974 A1 Nov. 19, 2009

(51) Int. Cl.
*B03C 3/013* (2006.01)
*B03C 3/15* (2006.01)

(52) U.S. Cl. ..... 95/58; 95/62; 95/70; 95/78; 96/27; 96/55; 96/61

(58) Field of Classification Search ..... 95/70, 78, 95/58, 62; 96/55, 60, 62, 27, 61, 74
See application file for complete search history.

(56) References Cited

U.S. PATENT DOCUMENTS

| | | | | | |
|---|---|---|---|---|---|
| 2,081,772 | A | * | 5/1937 | Saint-Jacques | 95/63 |
| 2,594,805 | A | * | 4/1952 | Rommel | 96/61 |
| 2,748,888 | A | * | 6/1956 | Hodson | 96/61 |
| 4,141,698 | A | * | 2/1979 | Kihlstedt et al. | 95/69 |
| 4,352,681 | A | * | 10/1982 | Dietz | 96/61 |
| 4,390,426 | A | * | 6/1983 | Vicard | 210/243 |
| 4,478,613 | A | * | 10/1984 | Brettschneider et al. | 96/61 |
| 5,591,253 | A | * | 1/1997 | Altman et al. | 96/61 |
| 5,683,494 | A | * | 11/1997 | Altman et al. | 96/55 |
| 5,961,693 | A | | 10/1999 | Altman et al. | |
| 5,968,231 | A | * | 10/1999 | Parmentier et al. | 95/28 |
| 5,972,215 | A | * | 10/1999 | Kammel | 210/243 |
| 6,096,118 | A | | 8/2000 | Altman et al. | |
| 6,197,096 | B1 | * | 3/2001 | Cartellone | 96/55 |
| 6,228,148 | B1 | * | 5/2001 | Aaltonen et al. | 95/74 |
| 6,582,500 | B1 | * | 6/2003 | Ohadi et al. | 96/61 |
| 7,156,902 | B1 | * | 1/2007 | Altman | 96/53 |
| 7,381,248 | B2 | * | 6/2008 | Kim et al. | 96/61 |
| 7,883,558 | B2 | * | 2/2011 | Gottung et al. | 55/315 |
| 2008/0060522 | A1 | * | 3/2008 | Bertuccioli et al. | 96/55 |
| 2009/0277325 | A1 | * | 11/2009 | Gottung et al. | 95/8 |

FOREIGN PATENT DOCUMENTS

| | | | | | |
|---|---|---|---|---|---|
| JP | 5-154328 | A | * | 6/1993 | 96/61 |

* cited by examiner

*Primary Examiner* — Richard L Chiesa
(74) *Attorney, Agent, or Firm* — Sutherland Asbill & Brennan LLP

(57) ABSTRACT

Embodiments of systems and methods for inducing swirl in particles are provided. In one embodiment, a system for inducing swirl in particles may include a supply including a plurality of electrically charged particles, and at least one swirling chamber for creating at least one electrical field therein, which may include an entry path in communication with the supply and an exit path. According to this example embodiment, the plurality of electrically charged particles may flow through the swirling chamber or chambers, causing at least one of the plurality of electrically charged particles to rotate about a radial axis of the swirling chamber as a result of the electrical field.

19 Claims, 4 Drawing Sheets

SYSTEMS AND METHODS FOR INDUCING SWIRL IN PARTICLES

TECHNICAL FIELD

The invention relates generally to particle separation and, more particularly, to systems and methods for inducing swirl in particles.

BACKGROUND OF THE INVENTION

Contaminants may exist in gaseous streams. In many industrial or commercial applications the contaminants must be at least partially separated or removed. Contaminants may be in the form of combustion bi-product, or may be dust, liquid, organic matter, or other particulates from various sources.

Various techniques exist to attempt particle removal from gaseous streams. For example, filtration, washing, centrifugation or vortexing, agglomeration, and electrostatic precipitation are used for particle removal. Filtration, for example, passes the gaseous stream through a mechanical filter that may selectively trap particles of a given size. Filtration requires that the filter be cleared or replaced, thus disturbing the operation of the device with which the gaseous stream is associated. Washing includes the introduction of another liquid into the gaseous stream the cleanser. However, the cleanser must be further treated or removed from the gaseous stream.

Centrifugation, also referred to as vortexing or cyclone separation, separates particles from the gas stream by way of centrifuge, or spinning particles in the gaseous stream. During centrifugation, a rotational velocity caused in the gas stream facilitates separating particles depending upon size. However, centrifugation is limited by particle size and mass constraints because the smaller the particle, the less effective the centrifugation becomes. To increase the rotational velocity, and thus alter the particle size which may be collected, the gaseous stream must be introduced at an increased velocity. Increased velocities result in greater pressure drops and more mechanical wear on the hardware, reducing the overall operating efficiency and longevity of the device.

Agglomeration allows the mixing and adhesion or grouping of particles together, thus increasing the size and mass, allowing for further methods for removal. Occasionally, agglomeration includes the addition of a sorbent having qualities that encourages adhesion by the particles to be removed. The agglomerated particles, including the sorbent and unwanted particles, may be removed, for example, by electrostatic precipitation as discussed below, mechanical or chemical filtration, centrifugation, or the like. However, agglomeration techniques decrease the effectiveness and efficiency of the additional particle removal method. Thus, there exists a need to improve agglomeration efficiencies.

Electrostatic precipitators electrically charge the unwanted particles, which are then passed near oppositely charged collecting electrodes that collect the charged particles. The unwanted particles may then either be collected from the collecting electrodes or, alternatively, directed by way an electrical field away from the gas outlet for later collection.

Each of these above-discussed methods of particle separation have certain disadvantages. For example, the above-discussed methods often result in a pressure drop in the gaseous stream, decreasing the efficiency of gas flow. Additionally, some of the above-discussed methods are limited by particle size or type, and do not provide a flexible, adjustable method of removing particles from a gaseous stream. Furthermore, the mechanical vortexing or centrifugation techniques require increasing the gas velocity introduced to increase the rotational velocity, which increases the resultant pressure drop and increases wear in the hardware.

Thus, there is a need for systems and methods that induce swirl in particles.

There is a further need for systems and methods that may flexibly, adjustably, and selectively separate, remove, or mix particles from a gaseous stream by way of inducing swirl to particles in the gaseous stream.

BRIEF DESCRIPTION OF THE INVENTION

Embodiments of the invention can address some or all of the needs described above. Embodiments of the invention are directed generally to systems and methods that induce swirl in particles.

According to one example embodiment, a system for inducing swirl in particles is provided. The system may include a supply including a plurality of electrically charged particles, and at least one swirling chamber for creating at least one electrical field therein, which may include an entry path in communication with the supply and an exit path. According to this embodiment, the plurality of electrically charged particles may flow through the swirling chamber or chambers, causing at least one of the plurality of electrically charged particles to rotate about a radial axis of the swirling chamber as a result of the electrical field.

According to another example embodiment of the invention, a method for inducing swirl in particles is provided. This example method may include introducing a supply comprising a plurality of electrically charged particles to at least one swirling chamber, creating at least one electrical field in the swirling chamber or chambers, and causing at least one of the plurality of electrically charged particles to rotate about an axis radially aligned with the swirling chamber or chambers by the electrical field.

According to yet another example embodiment of the invention, a system for inducing swirl in particles is provided. The system may include a supply comprising a plurality of particles, at least one pre-charging chamber in communication with the supply for imparting an electric charge to the plurality of particles. The system further may include at least one swirling chamber comprising an entry path in communication with the supply and an exit path and at least one electrical field inducer for controllably producing at least one electrical field in the swirling chamber or chambers. According to this example method, the supply may flow through the pre-charging chamber or chambers, imparting an electrostatic charge to the plurality of particles, through the swirling chamber or chambers, causing at least one of the plurality of electrically charged particles to rotate about a radial axis of the swirling chamber as a result of the electrical field, and exit the swirling chamber or chamber. Additionally, the rotation of the plurality of charged particles within the at least one swirling chamber may cause at least one of agglomeration, separation, or mixture with additional particles.

Other embodiments and aspects of the invention will become apparent from the following description taken in conjunction with the following drawings.

BRIEF DESCRIPTION OF THE DRAWINGS

Figure 1:
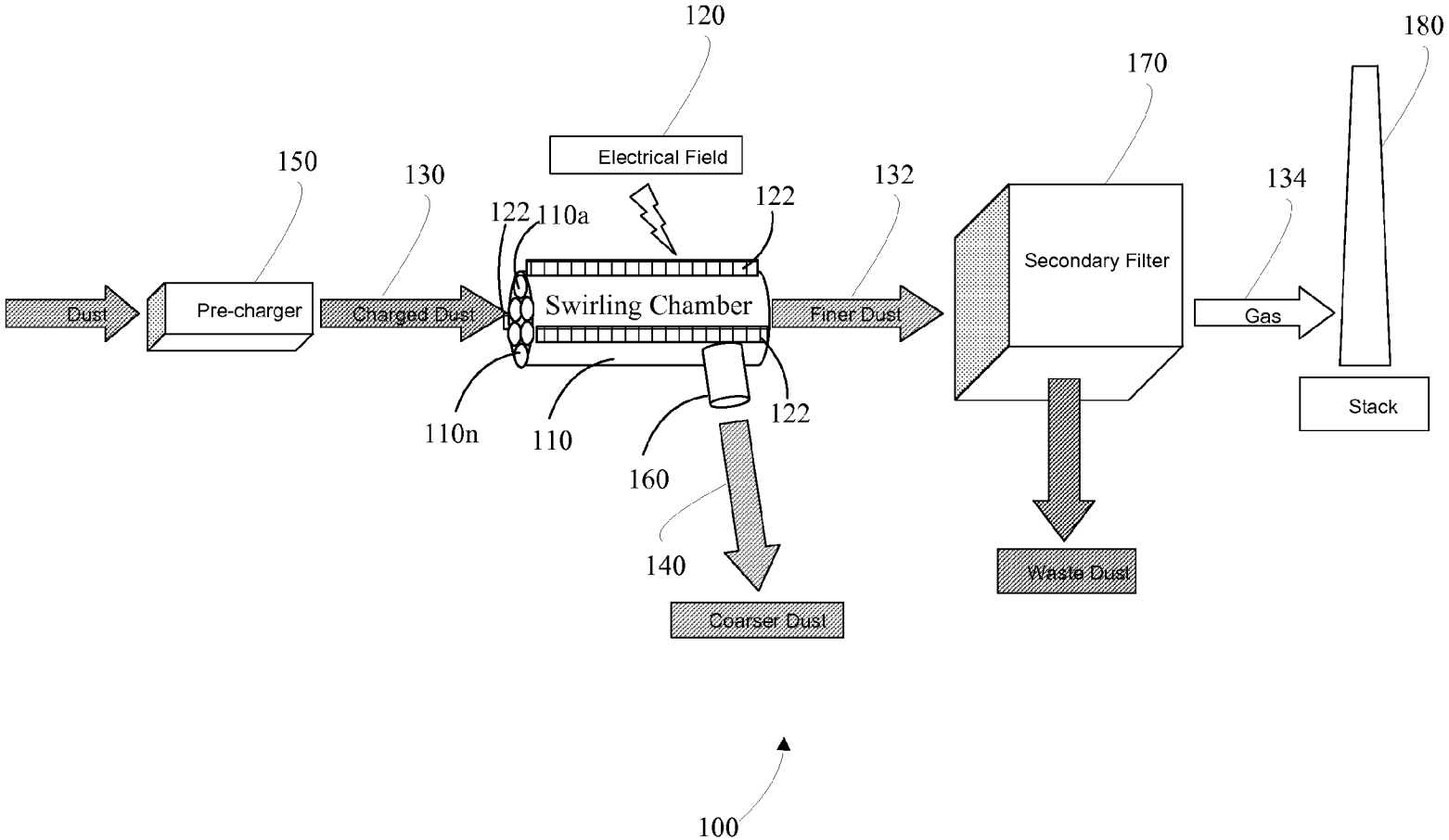

Having thus described embodiments of the invention in general terms, reference will now be made to the accompanying drawings, which are not necessarily drawn to scale, and wherein:

FIG. 1 is a functional block diagram of an example particle separation system in accordance with an embodiment of the invention.

Figure 2:
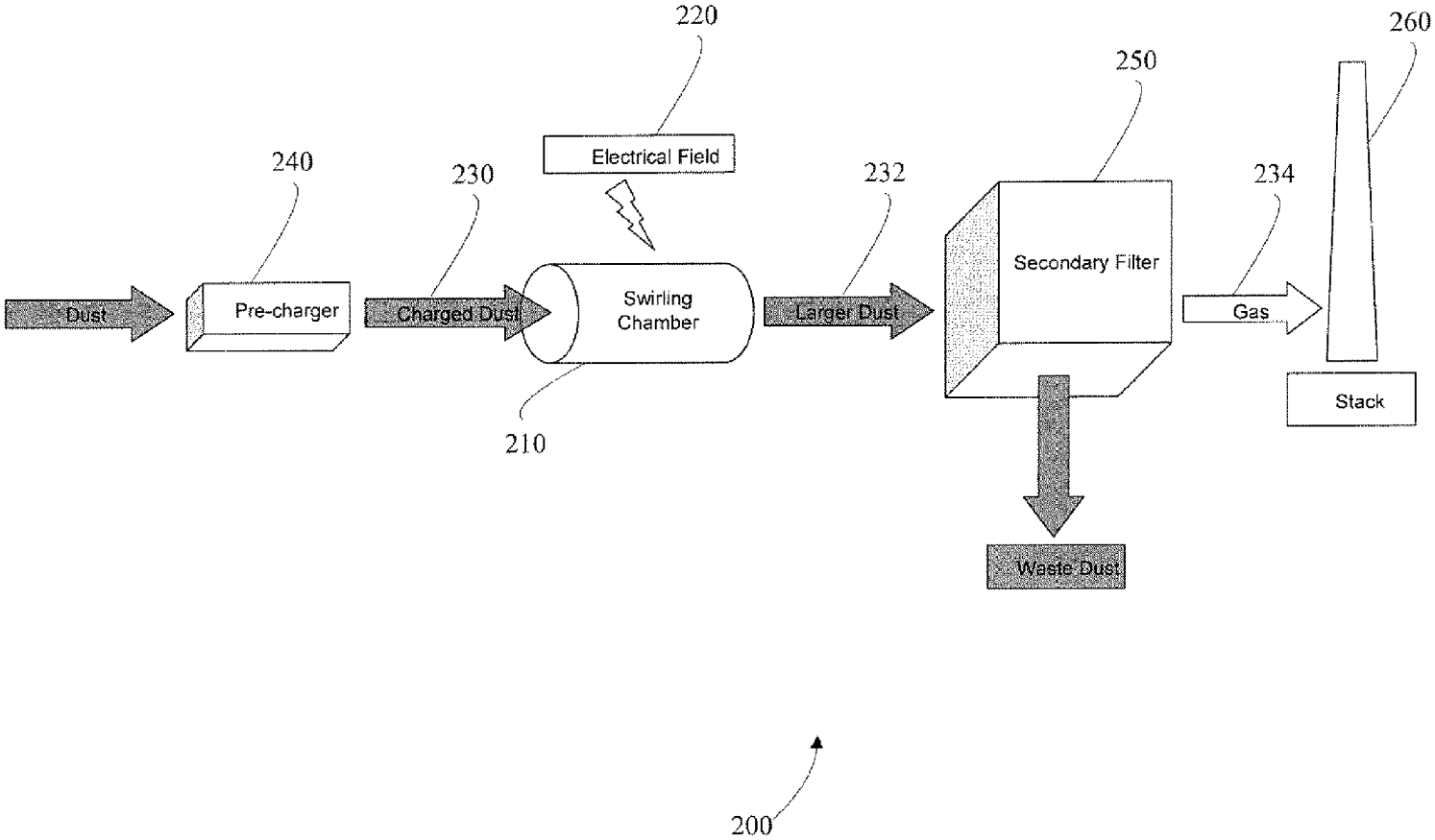

FIG. 2 is a functional block diagram of an example particle agglomeration system in accordance with an embodiment of the invention.

Figure 3:
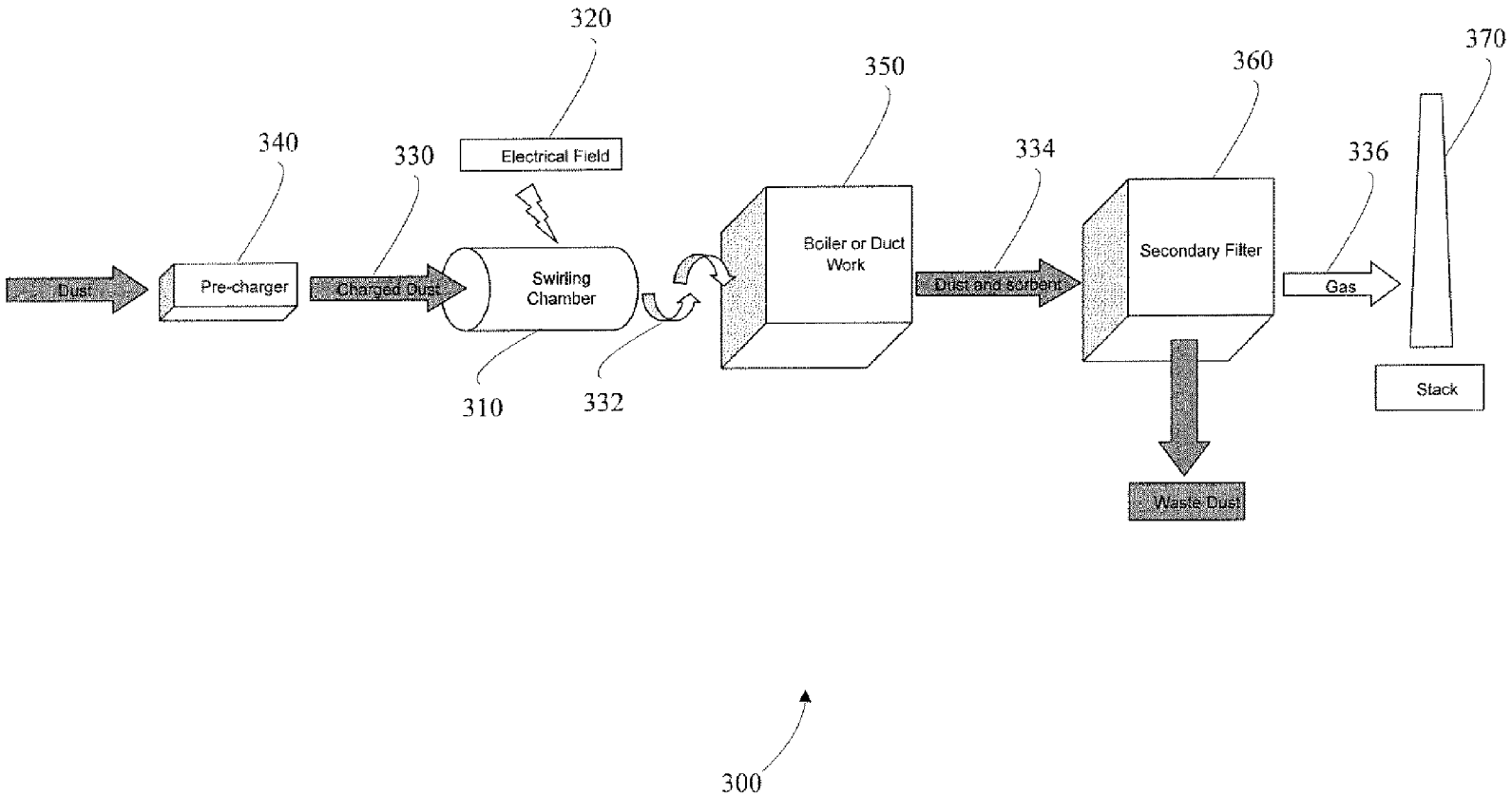

FIG. 3 is a functional block diagram of an example particle mixing system in accordance with an embodiment of the invention.

Figure 4:
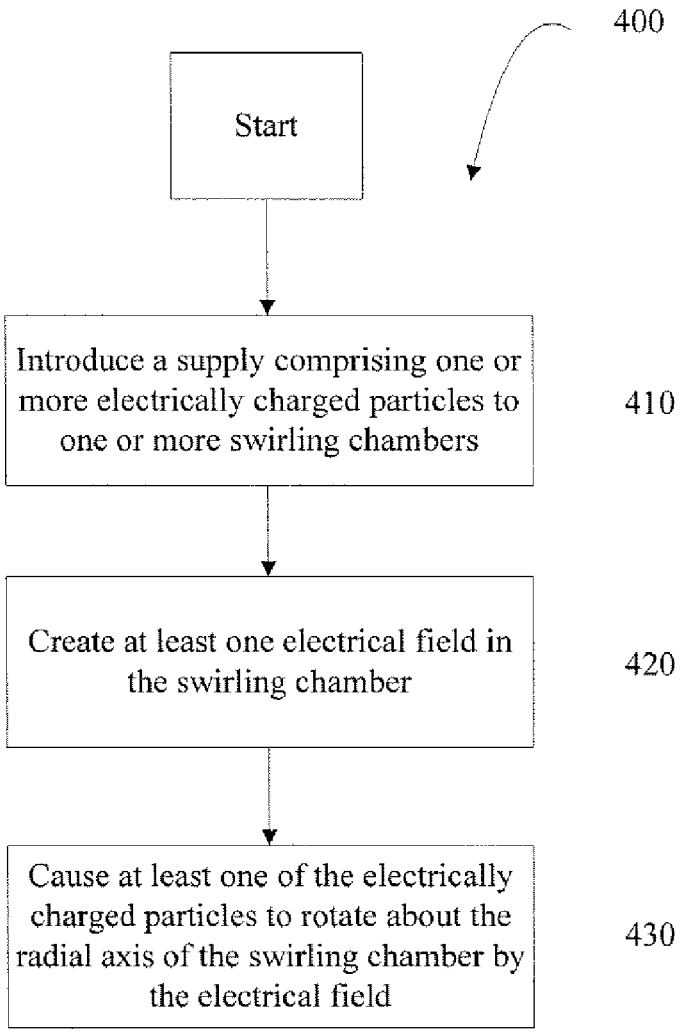

FIG. 4 is a flowchart illustrating an example method by which an embodiment of the invention may operate in accordance with an embodiment of the invention.

DETAILED DESCRIPTION OF THE INVENTION

Example embodiments of the invention now will be described more fully hereinafter with reference to the accompanying drawings, in which some, but not all embodiments are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Systems and methods for inducing swirl in particles are provided for and described. Embodiments of these systems and methods can allow for inducing swirl in electrically charged particles, also referred to herein as ions, to facilitate particle separation, particle removal, agglomeration, and/or sorbent mixing in gas streams. In an example embodiment, at least one swirling chamber is positioned in a gas stream containing electrically charged particles. The swirling chamber may have an electrical field in the chamber that induces the electrically charged particles in the gas stream to rotate about a radial axis of the swirling chamber or chambers. In some example embodiments, the electrical field may be electrostatically generated. The rotation of the electrically charged particles about the radial axis of the swirling chamber creates a tangential velocity in the particles.

The tangential velocity exhibited by the particles may allow for separation of the charged particles due to their size because particles having a larger mass will hold a greater charge and will experience a greater tangential velocity, enabling separation from charged particles have a smaller mass. Upon separation by way of varied tangential velocities, the particles may be treated differently in the gas stream. For example, dust particles may be collected by one or more collectors for discharging from the gas stream.

Additionally, the swirling effect on the electrically charged particles encourages mixture of the various charged particles in the stream. The mixture of the charged particles may, in some examples, facilitate agglomeration. Agglomeration allows particles of varying sizes to agglomerate, or bind together, which is helpful in downstream filtering or particulate removal processes that are less effective for smaller particle sizes.

In other example embodiments, the swirling effect caused by the electrical field in the swirling chamber or chambers may be applied to sorbents, such as activated carbon, that adsorb cause waste particles, such as oxidized mercury. Accordingly, a mixing nozzle or nozzles that introduce sorbents into a gas stream may be configured to include one or more swirling chambers to create a tangential velocity in the sorbents. In this example embodiment, the sorbents may be charged prior to entry into the mixing nozzle to allow for their electrical reaction to the field created in the swirling chamber. Because the ratio of sorbents to the gas volume is typically quite low, and because the gas volume typically flows at high rates, it is beneficial to facilitate mixing of the sorbents with the gas volumes. Thus, by swirling the sorbents in one or more swirling chambers associated with sorbent mixing nozzles, mixture with the waste particles in the gas stream is improved.

The tangential velocity of the swirled particles can be altered by altering properties of the electrical field. For example, the strength of the field may be varied, such as by varying the voltage difference applied, thus resulting in an increase, or decrease, in the tangential velocities of the swirled particles when the voltage difference is increased, or decreased, respectively. In another example, the frequency of the voltage waveform may be varied, similarly varying the tangential velocities of the swirled particles as the frequency is increased or decreased. In other swirl-inducing systems, such as those mechanically inducing swirls (e.g., centrifugation or vortexing), tangential velocity may only be increased by increasing the velocity of the gas (or other particulate) stream applied, resulting in greater wear on the hardware and greater pressure drops causing decreased operational efficiencies. Thus, by increasing tangential velocities of the charged particles by varying the strength and/or frequency of the applied electrical field, further operational efficiencies and less component wear are realized, as compared to previous mechanically-induced methods.

Accordingly, certain embodiments of the systems and methods described herein allow for inducing a swirl to assist particle removal. Furthermore, certain embodiments of the systems and methods described herein allow for swirl to be electrically induced in electrically charged particles during treatment of gaseous streams. Still further, certain embodiments of the systems and methods described herein provide for electrically inducing swirl in electrically charged particles, which may be used to facilitate particle separation, particle removal from gaseous streams, agglomeration, and/or sorbent mixture with gaseous streams.

FIG. 1 illustrates a functional block diagram of an example particle separation system 100 in accordance with an embodiment of the invention. The example particle removal system 100 may be used to facilitate particle separation and/or particle removal from a gaseous stream, for example, in a power generation plant or a materials manufacturing plant, by way of electrically inducing swirl in electrically charged particles, or ions, contained in the gaseous stream. The electrically charged particles may be, for example, waste particles such as dust or oxidized mercury. The particle separation system 100 includes at least one swirling chamber 110. The swirling chamber may be associated with one or more electrical field inducers 120, for creating an electrical field in the one or more swirling chambers 110. A supply 130 of gas and/or electrically charged particles is in communication with and introduces a particulate volume to the swirling chamber or chambers 110. The supply 130 may contain electrically charged particles which are to be separated, and possibly removed, by the particle separation system 100 of this example. In one example embodiment, the particle separation system 100 may be adapted to separate particles above a certain size, for removal or subsequent treatment. In another example embodiment, the particle separation system 100 may be adapted to separate all or substantially all particles, for removal or subsequent treatment. It is appreciated that in example embodiments, the supply 130 includes a gaseous stream, while in other example embodiments, the supply 130 may not include a gas but may include electrically charged particles, such as sorbent. Accordingly, as used herein, the term "supply" may refer to a stream that may include a volume of gas, a volume of electrically charged particles, or a combination thereof.

The one or more swirling chambers 110 include an entry path, through which the gas and/or charged particulate supply 130 enters, and an exit path, through which the gas and/or charged particulate supply 130 exits. In one embodiment, the swirling chamber may be configured in generally a cylindrical configuration. Having a cylindrical shape, the swirling chamber 110 has a radial axis passing through the approximate middle of the cylinder. The electrically charged particles rotate about the radial axis when subjected to the electrical field caused by the electrical field inducer 120, as is more fully described below. In one example embodiment, the swirling chamber 110 includes multiple chambers 110*a*-110*n* concentrically aligned, each generally having a cylindrical shape. In a configuration where the swirling chamber 110 includes multiple chambers 110*a*-110*n*, the gas and/or particulate flow may be substantially equally divided among the multiple chambers 110*a*-110*n*, and the individual chambers 110*a*-110*n* may have operate at a flow velocity less than the entire swirling chamber 110 velocity. Furthermore, in the configuration including multiple chambers 110*a*-110*n*, one or more electrical field inducers 120 may be associated with and cause an electrical field in each of the multiple chambers 110*a*-110*n*.

The electrical field inducer 120 is included in the particle separation system 100 of this example to create an electrical field within the swirling chamber or chambers 110. In one example embodiment, the electrical field inducer 120 may be configured to create an electrostatic field within the swirling chamber 110. The electrostatic field may be created by multiple electrodes 122 circumferentially arranged and connected in groups, and powered by a voltage power supply, for example, a multi-phase voltage power supply, so as to attain the desired rotating electric field when energized. In one example configuration, the electrical field inducer 120 may include three electrodes 122 positioned around the swirling chamber 110 and equally spaced apart (i.e., approximately 120 degrees apart), with their axes aligned with the radial axis of the swirling chamber 110. In the example having three electrodes 122, the phase of the voltage waveforms supplied by the power supply to each of the three electrodes 122 may also be spaced by approximately 120 degrees. The frequency may be substantially consistent between each electrode 122, so as to produce the desired swirling effect in the electrically charged particles passing therethrough. In other example embodiments any number of electrodes 122 may be included in the electrical field inducer 120.

The electrical field inducer 120 produces an electrical field within the swirl chamber 110 that rotates around the radial axis of the chamber. When electrically charged particles pass through the swirling chamber 110, they interact with the electrical field produced therein and rotate, or swirl, around the same radial axis, and thus have a tangential velocity component to their path of travel. Producing a tangential velocity, also referred to herein as rotational velocity, in the electrically charged particles allows further separation and possibly removal of swirling particles from the gas stream flowing through the swirling chamber 110. Furthermore, because the tangential velocity is induced in the particles through electrostatic forces, the tangential velocity may be adjusted by adjusting either the strength of the electrical field (voltage difference) or the frequency of the voltage waveform applied by the electrical field inducer 120.

Adjusting the electrical field, and thus adjusting the tangential velocity of the charged particles in the swirling chamber 110, allows for separating particles that would have varying interactions with the electrical field based at least partially on their size or mass. For example, increasing the electrical field strength and/or frequency would allow separating smaller particles than would be separated from the gas stream with lower electrical field strength and/or frequencies. In one example embodiment, separating particles by size allows removal particles above certain sizes, by a collector 140, as is further described below. In another example embodiment, separating particles by size allows selectively treating particles at different stages, or positions, in the gaseous stream, such as separating larger particles from the stream prior to exposing them to an electrostatic separator, a fabric filter, a membrane filter, or the like. Furthermore, in another example embodiment, a series of swirling chambers 110 with electrical field inducers 120 may be employed, whereby each swirling chamber 110 is operable to separate specific particle sizes. For example, a first swirling chamber 110 may separate larger particles, and a second swirling chambers, having a separate electrostatic field applied thereto, may separate smaller particles for different treatment.

In the example particle separator system 100 illustrated at FIG. 1, the supply 130 is presumed to contain at least some waste particles, or other particles to be separated by the system from the gaseous stream. To improve swirling caused in the swirling chamber 110 and the electrical field inducers 120, the particles in the gaseous supply may be charged. The particles may be charged by exposing them to an electrical charge. In one example embodiment, the particle separator system 100 optionally includes a pre-charging chamber 150, as is illustrated in FIG. 1, through which the supply 130 may pass prior to its introduction to the swirling chamber 110. The pre-charging chamber 150 may include one or more powered electrode pairs that ionize particles passing through an electrostatic field. In other example embodiments, particles may be ionized or electrically charged by supplying an ion or electron source, or by triboelectric charging. It is appreciated that particles may be ionized, or electrically charged, by other means prior to introduction to the swirling chamber 110.

In one example embodiment, the swirling chamber 110 may include one or more collectors 160, creating a duct or a passage between the interior of the swirling chamber 110 and external to the swirling chamber 110 and away from the gaseous stream. The collector 160 may be positioned at or substantially near the distal portion of the swirling chamber 110 so as to discharge electrically charged particles from the swirling chamber 110 near or immediately prior to the exit path. As the charged particles swirl as a result of the electrical field created by the electrical field inducers 120 their tangential velocity propels them through the collector 160 as discharged particles 140. The collector 160 may further communicate with an additional collection device for further separation, disposal, reuse, or other application of the discharged particles 140. Accordingly, in the example embodiment including the collector 160, the supply 130 is separated into discharged particles 140 and a cleansed stream 132, as is illustrated in FIG. 1.

After separation, and possible removal, the cleansed stream 132 may optionally be introduced to a secondary filter 170, such as an electrostatic precipitator, fabric filter, membrane filter, or the like, for further treatment and cleansing. Additional waste, such as dust, or the like, may be filtered and removed from the gaseous stream by the secondary filter 170. After exposure to the secondary filter 170, the gaseous stream consists of a filtered stream 134, which is then exhausted from the system through a stack 180. It is appreciated, however, that the secondary filter 170 is not required for operation of the particle separation system 100, and thus the cleansed stream 132 may exit the swirling chamber 110 and be exhausted through the stack 180.

FIG. 2 illustrates a functional block diagram of an example particle agglomeration system 200 in accordance with an embodiment of the invention. The example particle agglomeration system 200 may be used to facilitate particle agglomeration within a gaseous stream, for example, in a power generation plant or a materials manufacturing plant, by way of electrically inducing swirl in electrically charged particles, or ions, contained in the gaseous stream. Agglomeration of particles is caused in a manner similar to that describing particle separation and removal, with reference to FIG. 1. Agglomeration of particles, such as waste particles, occurs when high levels of mass transfer occur, such as when fine, or small, particles collide with larger, or coarse particles, causing the smaller particles to bind, or agglomerate, to the larger particles. The frequency of collision between the various-sized particles is increased by the swirl induced by the electrical field.

In one example embodiment, the particle agglomeration system 200 includes at least one swirling chamber 210. The swirling chamber 210 may function like that described above with reference to the particle separation system 100. For example, the swirling chamber is also associated with one or more electrical field inducers 220, for creating an electrical field in the one or more swirling chambers 210, as described above. Additionally, the swirling chamber 120 may optionally include multiple, concentrically aligned chambers, with individual electrical field inducers 220, also as described above. A supply 230, such as a gas supply, is in communication with and introduces a gas volume to the swirling chamber or chambers 210. The supply 230 may contain electrically charged particles, which are to be agglomerated by the particle agglomeration system 200 of this example. The particles in the gas chamber may be ionized, or charged, by way of a pre-charging chamber 240, as described above. After being passed through the swirling chamber 210, the gaseous stream passes into a secondary filter 250, such as an electrostatic precipitator, a fabric filter, a membrane filter, or the like, and then exhausts the system through a stack 260.

The particle agglomeration system 200 induces swirl in the electrically charged particles in the supply 230, to encourage the agglomeration, or binding, of particles having varying sizes. The swirling, or tangential velocity, of the particles in the swirling chamber 210 facilitates exposure of particles of different size to each other and, thus, increases the opportunity for agglomeration. Agglomeration can increase particle collection efficiencies and/or increase maintenance intervals, depending upon the filtration mechanism used. For example, for some filtration mechanisms, such as an electrostatic precipitator or a cyclone separator, waste collection efficiencies increase as particle size increases. In other filtration mechanisms, such as fabric filters, pressure drop increases as smaller particles collect in the filter medium, thus requiring more frequent maintenance.

Accordingly, the example particle agglomeration system 200, illustrated in FIG. 2, acts by inducing a swirl on electrically charged particles existing in the supply 230. While swirling, the charged particles agglomerate, or bind to other particles, effectively increasing the particle size exiting the swirling chamber 210 in an agglomerated stream 232. The agglomerated stream 232 is then subjected to the secondary filter 250 for waste removal. The increased particle size in the agglomerated stream 232 allows for more efficient filtration and/or reduces maintenance. A cleansed stream 234 may then exit the secondary filter 250, and exhaust from the system through a stack 260.

Agglomeration, as is described in reference to FIG. 2, may also occur during the operation of the particle separation system 100, described in reference to FIG. 1. Because the swirling chambers 110, 210 and the electrical field inducers 120, 220 operate in the same manner with respect to the particle separation system 100 and the particle agglomeration system 200, agglomeration may occur in either system. Additionally, a collector, similar to the collector 160, may further be included in the particle agglomeration system 200, so as to allow discharge of certain-sized particles based on the tangential velocity exhibited in the swirl chamber 210.

In another example embodiment, a volume of activated sorbent particles may be introduced into the particle agglomeration system 200. Sorbent may adsorb waste, such as oxidized mercury, increasing the size of the particles containing waste, and improving collection efficiencies. Powder-activated carbon is a typical sorbent used to adsorb oxidized mercury at exhaust temperatures. Upon introduction of charged sorbent to the swirling chamber 220, the sorbent and the other charged waste particles in the gaseous stream will swirl about the radial axis of swirling chamber 220. The swirling, as occurs during agglomeration, will facilitate adsorption of waste particles by the sorbent. It is further contemplated that a collector, like the collector 160, may optionally be integrated with the swirling chamber to allow discharge of sorbent particles bound with waste particles, in a manner similar to that described with reference to FIG. 1.

FIG. 3 illustrates a functional block diagram of an example particle mixing system 300 in accordance with an embodiment of the invention. The example particle mixing system 300 may be used to facilitate mixing of particles being introduced to a gaseous stream, for example, in a power generation plant or a materials manufacturing plant, by way of electrically inducing swirl in electrically charged particles passing through the system. For example, the particle mixing system 300 may be used to induce swirl to sorbent particles in existing injection nozzles, prior to introducing the sorbent to a gaseous stream. Inducing swirl in the sorbent particles promotes mixing the sorbent with the gas stream, and thus increases the likelihood of adsorption by the sorbent particles of the targeted waste particles in the gaseous stream, as is discussed with reference to an example embodiment of the particle agglomeration system 200 above.

In one example embodiment, the particle mixing system 300 includes at least one swirling chamber 310. The swirling chamber 310 may function like that described above with reference to the particle separation system 100 or the particle agglomeration system 200, except that a volume of sorbent is swirled instead of, or in some embodiments in addition to, the gas supply. In one example embodiment, the swirling chamber or chambers 310 may be a part of, or replace, existing sorbent injection nozzles. A sorbent supply 330 is in communication with and introduces a volume of sorbent particles to the swirling chamber or chambers 310. In one example, the sorbent may be activated carbon for mercury removal. It is appreciated that the sorbent supply 330 may include one or more other example sorbent particle types. The sorbent particles in the sorbent supply 330 are electrically charged, which may be achieved by a pre-charging chamber 340. As is described above with reference to FIG. 1 and FIG. 2, the electrical field caused by one or more electrical field inducers 320 associated with the swirling chamber or chambers 310 cause the electrically charged sorbent particles to rotate about the radial axis of the swirling chamber 310 and to exhibit a tangential velocity. The velocity of the particles may be controlled by varying the strength/and or the electrical field in the swirling chamber 310, as is described above. After being passed through the swirling chamber 310, the swirled sorbent 332 passes into a boiler or duct work 350 where combustion may occur. After exiting the boiler or duct work 350, the adsorbed stream 334 passes into a secondary filter 360, such as an electrostatic precipitator, a fabric filter, a membrane filter, or the like. Finally, the cleansed stream 336 then exhausts the system through a stack 370.

Accordingly, in one example embodiment, the example particle mixing system 300, illustrated in FIG. 3, acts by inducing a swirl on electrically charged sorbent particles in the sorbent supply 340, prior to mixing with a gaseous stream. For example, existing sorbent injection nozzles may be retrofit with the swirling chamber or chambers 310 and electrical field inducers 320. For retrofitting, one or more electrical field inducers 320 may be associated or integrated with existing sorbent injection nozzles. In another example, a swirling chamber 310 and electrical field inducer 320 may be added downstream from each existing injection nozzle. Alternatively, however, any existing injection nozzles may be completely replaced with one or more swirling chambers 310 and electrical field inducers 320.

Swirled sorbent particles exit the swirling chamber 310 in a swirled stream 332, prior to introducing the sorbent to the gaseous stream. Accordingly, the swirling increases the velocity of the sorbent and promotes mixing of sorbent into the gaseous stream. Greater mixing rates increase the likelihood of adsorption by the sorbent of the attracted waste particles in the gaseous stream. As is described above in reference to agglomeration, the binding of the waste particles to the sorbent improves waste collection efficiencies by secondary filtration or collection devices. By inducing swirl electrically, as opposed to mechanical methods such as distribution plates or vanes, the sorbent velocities may be more accurately and efficiently controlled and mechanical wear on the hardware may be reduced.

The swirled stream 332 is then introduced to the boiler or duct work 350 for combustion. Finally, the adsorbed stream 336 exits the boiler or duct work 350 and is subjected to the secondary filter 360 for waste removal or separation and then exhausts through the stack 370. As is described above, increased particle size in the adsorbed stream 336 allows for more efficient filtration and reduces hardware maintenance requirements.

FIG. 4 illustrates an example method by which an embodiment of the invention may operate in accordance with an embodiment of the invention. Provided is a flowchart 400 illustrating an example method for inducing swirl in at least one electrically charged particle, such as with example embodiments described in reference to FIGS. 1-3.

At block 410, a supply that contains electrically charged particles may be introduced to one or more swirling chambers. The supply may be, for example, gas containing electrically charged particles, electrically charged sorbent particles, other electrically charged particles, any combination thereof, or the like. Furthermore, in an example embodiment, as described above, the method may further include introducing the supply to a pre-charging chamber to impart the electrical charge on the particles, prior to introducing the supply to the swirling chamber.

Block 410 is followed by block 420, in which one or more electrical fields are created in each swirling chamber. The electrical fields may be an electrostatic field, for example. The electrical field may be created by one or more electrical field inducers, as are described above. It is appreciated that in some embodiments the electrical field may be created in the swirling chamber prior to the introduction of the supply and the electrically charged particles. Additionally, the swirling chambers may be configured as a single, substantially cylindrical form, or may be multiple, concentrically aligned cylindrical chambers, as described above. It is further appreciated that the swirling chamber or chambers may additionally include one or more collectors, which allow the discharge of electrically charged particles from the swirling chambers as a result of their swirling motion and tangential velocities.

Block 420 is followed by block 430, in which the electrical field inducers cause one or more electrical fields in the swirling chambers, as described above. The electrical fields created cause the electrically charged particles, such as waste particles, dust, mercury, sorbent, or the like, to be rotate rotated about the radial axis of the swirling chamber. Accordingly, the electrically charged particles exhibit a tangential velocity, the magnitude of which may be controlled by varying the electrical field strength and/or the frequency. Exhibiting a tangential velocity allows the electrically charged particles to be separated, removed by the collector described above, mixed with other particles or gas streams, or the like.

It is further appreciated that the method illustrated by FIG. 4 may further include introducing the gaseous stream to one or more filtration mechanisms, such as an electrostatic precipitator, a fabric filter, a membrane filter, a mechanical separator, or the like, after being swirled by the swirling chamber. Furthermore, additional treatment, filtration, and/or reintroduction of removed particles from the gaseous stream is also possible by embodiments of these methods.

Many modifications and other embodiments of the example descriptions set forth herein to which these descriptions pertain will come to mind having the benefit of the teachings presented in the foregoing descriptions and the associated drawings. Thus, it will be appreciated the invention may be embodied in many forms and should not be limited to the example embodiments described above. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed is:

1. A system for inducing swirl in particles, comprising:

a supply comprising a plurality of electrically charged particles;

at least one swirling chamber for creating at least one electrical field therein, comprising an entry path in communication with the supply and an exit path, wherein the entry path is positioned proximate a first end of the at least one swirling chamber and the exit path is proximate a second end of the at least one swirling chamber downstream from the entry path, and wherein the entry path and the exit path lie approximately along a radial axis of the at least one swirling chamber;

wherein the plurality of electrically charged particles flows through the at least one swirling chamber, causing at least one of the plurality of electrically charged particles to rotate about the radial axis of the swirling chamber as a result of the at least one electrical field.

2. The system of claim 1, wherein the at least one electrical field comprises an electrostatic field.

3. The system of claim 1, wherein the at least one electrical field is created by a plurality of electrodes circumferentially arranged around the at least one swirling chamber and in electrical communication with at least one power source.

4. The system of claim 1, wherein at least one of the strength or the frequency of the electrical field is adjustably controlled.

5. The system of claim 1, further comprising at least one pre-charging chamber in communication with the supply and in communication with the entry path of the at least one swirling chamber, for imparting an electric charge to the plurality of particles.

6. The system of claim 1, wherein the at least one swirling chamber comprises a plurality of swirling chambers concentrically aligned, through which the plurality of electrically charged particles flow, each of the plurality of swirling chambers creating an electrical field therein.

7. The system of claim 1, further comprising at least one collector in communication with the interior of the at least one swirling chamber and positioned upstream of the exit path of the swirling chamber, through which the at least one of the plurality of electrically charged particles is discharged from the at least one swirling chamber.

8. The system of claim 1, further comprising at least one secondary filter in communication with the exit path of the at least one swirling chamber for collecting the at least one of the plurality of electrically charged particles.

9. The system of claim 1, wherein the supply comprises a gas volume, and wherein the at least one swirling chamber causes agglomeration in the plurality of electrically charged particles.

10. The system of claim 1, wherein the supply comprises a plurality of electrically charged waste particles and a plurality of electrically charged sorbent particles, wherein the at least one swirling chamber causes the at least one of the plurality of electrically charged waste particles to bind with the plurality of sorbent particles.

11. The system of claim 1, wherein the supply comprises a plurality of electrically charged sorbent particles, and further comprising a gas supply comprising a gas volume and a plurality of electrically charged waste particles, wherein the plurality of electrically charged sorbent particles are introduced to the gas volume after exit from the at least one swirling chamber to bind with the plurality of electrically charged waste particles.

12. A method for inducing swirl in particles, comprising:

introducing a supply comprising a plurality of electrically charged particles to at least one swirling chamber through an entry path defined proximate a first end of the swirling chamber and to exit the at least one swirling chamber through an exit path defined proximate a second end of the at least one swirling chamber downstream from the entry path, and wherein the entry path and the exit path lie approximately along a radial axis of the swirling chamber;

creating at least one electrical field in the at least one swirling chamber; and causing at least one of the plurality of electrically charged particles to rotate about the radial axis of the at least one swirling chamber by the at least one electrical field.

13. The method of claim 12, wherein creating the at least one electrical field comprises creating an electrostatic field.

14. The method of claim 12, further comprising adjusting at least one of the strength or the frequency of the electrical field.

15. The method of claim 12, further comprising introducing the supply to at least one pre-charging chamber for imparting an electric charge to the plurality of particles.

16. The method of claim 12, further comprising discharging the at least one of the electrically charged particles in at least one collector in communication with the interior of the at least one swirling chamber and positioned upstream from the exit path of the swirling chamber.

17. The method of claim 12, wherein the supply comprises a gas volume, and further comprising agglomerating the plurality of electrically charged particles at least partially as a result of the rotation of the plurality of electrically charged particles.

18. The method of claim 12, wherein the supply comprises a plurality of electrically charged sorbent particles, and further comprising a gas supply comprising a gas volume and a plurality of electrically charged waste particles, wherein the plurality of electrically charged sorbent particles are introduced to the gas volume after exit from the at least one swirling chamber to bind with the plurality of electrically charged waste particles.

19. A system for inducing swirl in particles, comprising:

a supply comprising a plurality of particles;

at least one pre-charging chamber in communication with the supply for imparting an electric charge to the plurality of particles;

at least one swirling chamber comprising an entry path in communication with the supply and an exit path, wherein the entry path is positioned proximate a first end of the at least one swirling chamber and the exit path is proximate a second end of the at least one swirling chamber downstream from the entry path, and wherein the entry path and the exit path lie approximately along a radial axis of the at least one swirling chamber; and at least one electrical field inducer for controllably producing at least one electrical field in the at least one swirling chamber;

wherein the supply flows through the at least one pre-charging chamber, imparting an electrostatic charge to the plurality of particles, through the at least one swirling chamber, causing at least one of the plurality of electrically charged particles to rotate about a the radial axis of the at least one swirling chamber as a result of the at least one electrical field, and exits the at least one swirling chamber; and wherein the rotation of the plurality of charged particles within the at least one swirling chamber causing at least one of agglomeration, separation, or mixture with additional particles.

* * * * *

UNITED STATES PATENT AND TRADEMARK OFFICE

CERTIFICATE OF CORRECTION

PATENT NO. : 7,964,021 B2
APPLICATION NO. : 12/122032
DATED : June 21, 2011
INVENTOR(S) : Younsi et al.

It is certified that error appears in the above-identified patent and that said Letters Patent is hereby corrected as shown below:

IN THE SPECIFICATIONS:
In Column 10, Line 15, after “be” delete “rotate”.

IN THE CLAIMS:
In Column 12, Line 47, in Claim 19, after “about” delete “a”.

Signed and Sealed this
Eleventh Day of October, 2011

David J. Kappos

David J. Kappos
*Director of the United States Patent and Trademark Office*